US007311072B2

(12) United States Patent
Hoffmann et al.

(10) Patent No.: US 7,311,072 B2
(45) Date of Patent: Dec. 25, 2007

(54) CONTROL UNIT FOR A VALVE, ESPECIALLY A GAS EXCHANGE VALVE OF AN INTERNAL COMBUSTION ENGINE

(75) Inventors: Hermann Hoffmann, Stuttgart (DE); Timothy Mark Lancefield, Shipston on Stour (GB); Martin Lechner, Stuttgart (DE); Ian Methley, Witney (GB)

(73) Assignees: Mahle Ventiltrieb GmbH, Stuttgart (DE); Mechadyne PLC, Kirtlingdon, Oxfordshire (GB)

( * ) Notice: Subject to any disclaimer, the term of this patent is extended or adjusted under 35 U.S.C. 154(b) by 29 days.

(21) Appl. No.: 10/574,000

(22) PCT Filed: Jul. 12, 2005

(86) PCT No.: PCT/DE2005/012180

§ 371 (c)(1),
(2), (4) Date: Mar. 30, 2006

(87) PCT Pub. No.: WO2006/007817

PCT Pub. Date: Jan. 26, 2006

(65) Prior Publication Data

US 2007/0039577 A1 Feb. 22, 2007

(30) Foreign Application Priority Data

Jul. 17, 2004 (DE) ..... 10 2004 034 710

(51) Int. Cl.
*F01L 1/02* (2006.01)

(52) U.S. Cl. ..... 123/90.27; 123/90.16; 123/90.15; 123/90.17; 123/90.2; 123/90.31

(58) Field of Classification Search ..... 123/90.27, 123/90.31, 90.16
See application file for complete search history.

(56) References Cited

U.S. PATENT DOCUMENTS 4,768,475 A 9/1988 Ikemura et al.
5,052,350 A 10/1991 King et al.

(Continued)

FOREIGN PATENT DOCUMENTS

DE 26 38 651 3/1978

(Continued)

OTHER PUBLICATIONS

International Search Report.

*Primary Examiner*—Thomas Denion
*Assistant Examiner*—Kyle M. Riddle
(74) *Attorney, Agent, or Firm*—Collard & Roe, P.C.

(57) ABSTRACT

A gas exchange valve of an internal combustion engine, has valve lifting movements with valve displacement curves and a control unit. To this end, a control unit is provided for operation of at least one valve, in particular a gas exchange valve of an internal combustion engine, in which the valvelifting movement of the at least one valve (6) is generated by superimposing two synchronously rotating cam profiles acting mechanically on a lift operating element (4). The two cam profiles (1, 2) have specially shaped areas by means of which, when superimposed to form one of the two cam profiles (1, 2), at least one additional valve displacement (ZV) can be generated on the whole in addition to a main valve displacement movement (HV) over a full revolution of each of these cam profiles (1, 2).

14 Claims, 8 Drawing Sheets

U.S. PATENT DOCUMENTS

Figure 1:
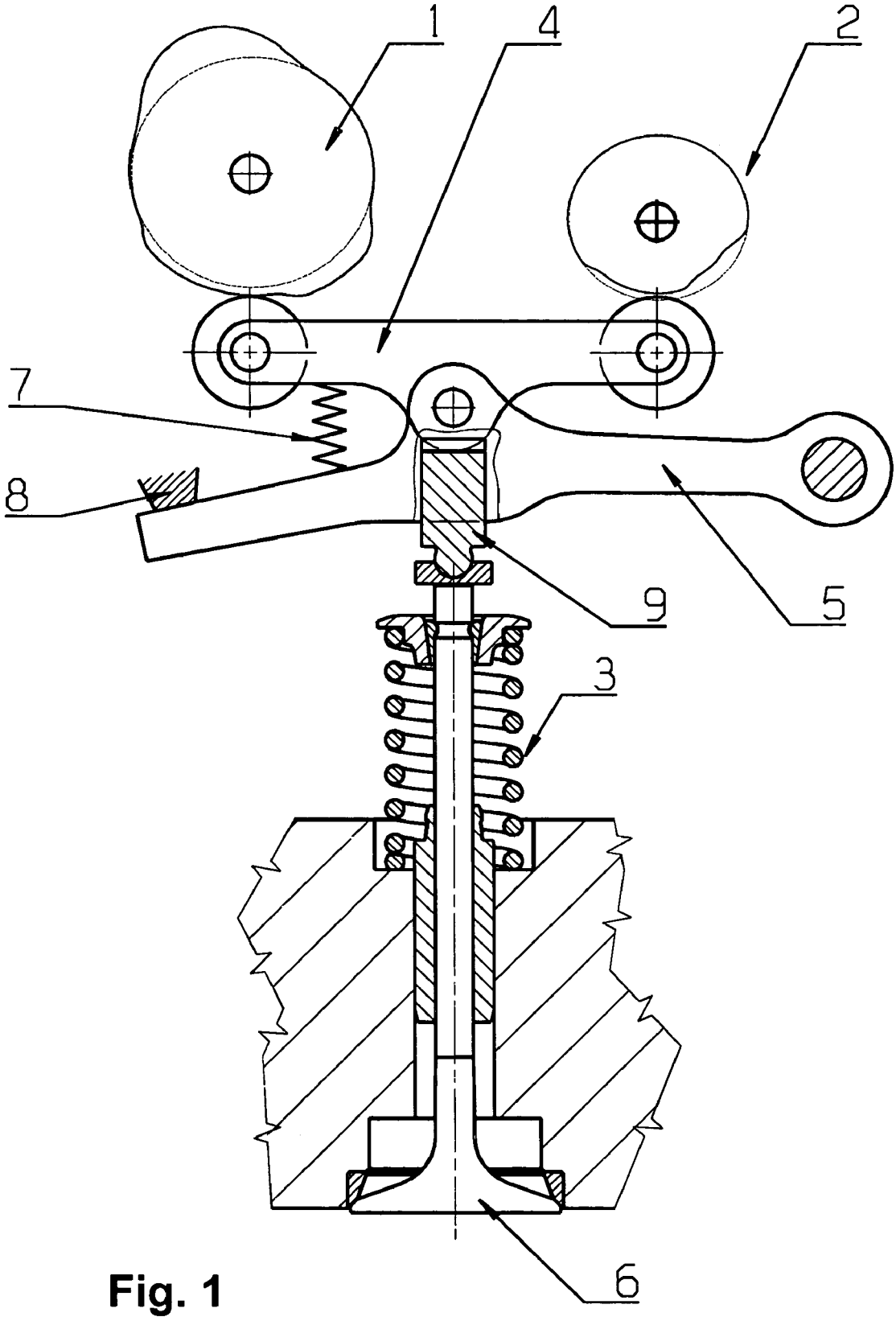

| | | | | |
|---|---|---|---|---|
| 5,555,860 | A * | 9/1996 | Wride | 123/90.16 |
| 5,642,692 | A * | 7/1997 | Wride | 123/90.16 |
| 2005/0211202 | A1 * | 9/2005 | Lechner et al. | 123/90.16 |

FOREIGN PATENT DOCUMENTS

| | | | |
|---|---|---|---|
| DE | 30 06 619 | A1 | 8/1981 |
| DE | 195 01 386 | C2 | 8/1996 |
| DE | 196 00 536 | A | 7/1997 |
| DE | 197 33 322 | A1 | 2/1999 |
| DE | 198 02 738 | A1 | 7/1999 |
| EP | 0 472 430 | A2 | 2/1992 |
| GB | 2 180 597 | A | 4/1987 |
| JP | 2002 309 918 | A | 10/2002 |
| JP | 2002 371 817 | A | 12/2002 |
| JP | 2003 120 241 | A | 4/2003 |
| WO | WO 00/31385 | A | 6/2000 |
| WO | WO 2004/067922 | A1 | 8/2004 |

* cited by examiner

CONTROL UNIT FOR A VALVE, ESPECIALLY A GAS EXCHANGE VALVE OF AN INTERNAL COMBUSTION ENGINE

CROSS REFERENCE TO RELATED APPLICATIONS

Applicants claim priority under 35 U.S.C. §119 of German Application No. 10 2004 034 710.7 filed Jul. 17, 2004. Applicants also claim priority under 35 U.S.C. §365 of PCT/DE2005/001218 filed Jul. 12, 2005. The international application under PCT article 21(2) was not published in English.

The invention relates to a control unit for operating at least one valve, in particular a gas exchange valve of an internal combustion engine in which the valve lifting movement of the at least one valve can be created by superimposing at least two synchronously rotating cam profiles, namely a first cam profile and a second cam profile, acting mechanically on a lift operating element, and can be varied by phase displacement between these two cam profiles.

Such a device is described in the older German Patent Application PCT/DE 2004/000079. However, with the cam profiles disclosed there, it is possible to create only a valve lifting movement having a single valve displacement curve and to vary the shape and course of this movement in virtually any desired manner through appropriate profile shapes and mutual phase shift of the two cam profiles acting on a common lift operating element.

German Patent DE 197 33 322 A1 describes a valve control unit with which an additional valve displacement curve can be generated by using two separately rotating cam profiles whose rotation is phase-shiftable. With this control unit that operates mechanically, no variability of the main valve displacement curve is possible. At the same time, the additional valve displacement curve is predetermined by the geometry of the camshaft and cannot be made continuously variable. The additional valve displacement there is created by a cam profile which does not come in contact with the lift operating element during the main valve displacement of a valve and can extend out of the action range of the cam only in a basic circular area of the cam profile generating the main valve displacement curve.

To be able to achieve additional valve displacements in addition to a main valve displacement, hydraulically mechanically operated combination systems are known from WO 00/31385, for example. With these devices, it is possible to generate various additional valve displacement curves for a main valve displacement curve. That combination mechanical and hydraulic unit has an extremely complicated design with a plurality of function elements and a high susceptibility to breakdowns accordingly.

The present invention relates to the problem of designing the control unit according to the older German Patent Application PCT/DE 2004/000079 cited above to yield a device having at least the options of mechanically/hydraulically operating control units according to WO 00/31385. The device to be created according to this invention should be usable, for example, for the brake system of an internal combustion engine of a motor vehicle and likewise in a vehicle internal combustion engine for internal engine supercharging through fresh air or exhaust gas or by illustrating novel combustion methods and for internal recycling of exhaust gas in the aforementioned internal combustion engines. In all these applications, a valve control unit must be capable of generating certain additional valve displacements for a main valve lift with respect to a full revolution of a cam profile.

This problem is solved by a control unit having all the features of the patent claim.

In the case of a control unit in which the lifting movement of a valve is generated by a lift operating element, the present invention is based on the general idea of jointly acting on the at least two synchronously rotating cam profiles for superimposing the cam profile curves, the present invention is based on jointly acting on the at least two cam profiles rotating in synchronization with one another for superimposing the cam profile curves, providing the cam profile curves with profile curves superimposed on the lift operating element with regard to the movement thereof such that per cam profile revolution, in addition to a main valve displacement curve which is definitive for the lifting movement, additional valve displacement curves of any form can be generated and can be assigned mutually and with respect to the main displacement curve. It is thus possible starting from the desired valve displacement curves, to generate suitable cam profile shapes and to do so through corresponding conventional computer generation methods.

Examples in this regard which will be used to further explain the present invention are explained below on the basis of the exemplary embodiments illustrated in the figures.

The drawings show:

FIG. 1 an example of a control unit suitable for implementing the present invention, FIGS. 2*a*-2*d* two synchronously rotating cam profiles (part b, part c) intended for joint operation of a lift operating element, including a diagram of the profile curves of these two cam profiles (part d) superimposed on the lift operating element in a phase relation $P_0$ and the valve lift curve achievable through the use these cam profiles with respect to the valve lifting movement, including a main valve displacement curve (HV) and an additional valve displacement curve (ZV) (part a), FIGS. 3*a*-3*d* an identical display derived from FIGS. 2*a*-2*d* for mutually phase-shifted cam profiles with a first phase shift by a value P1, FIGS. 4*a*-4*d* an identical display derived from FIGS. 2*a*-2*d* for mutually phase-shifted cam profiles with a second phase shift by a value P2, FIGS. 5*a*-5*d* a diagram like that shown in FIGS. 2*a*-2*d* through 4*a*-4*d* for differently shaped cam profiles with different phase shift positions between the two cam profiles, all shown in the same drawing, FIGS. 6*a*-6*d* a type of diagram like that in FIGS. 5*a*-5*d* for differently shaped cam profiles, FIGS. 7*a*-7*d* a type of diagram like that in FIGS. 5*a*-5*d* and 6*a*-6*d* for differently shaped cam profiles, FIGS. 8*a*-8*d* a type of diagram like that in FIGS. 5*a*-5*d*, 6*a*-6*d*, and 7*a*-7*d* for differently shaped cam profiles.

Valve control unit according to FIG. 1:

Two synchronously rotating camshafts that are mutually phase-variable and have a first and second cam profile 1 and 2 operate an intermediate element in the form of a lift operating element 4 designed as a lever with two contact rollers, transmitting the resulting adjustment path via a bearing axle to a force transmission lever 5 which then operates a valve via a play-equalizing device 9. The lever 5 is pressed against a stop 8 while the valve 6 is pressed by the force of the play-equalizing device 9. A spring 7 ensures that the lift operating element 4 is always in contact with the cam profile 1 via a contact roller. The phase relation of the two cam profiles 1 and 2 is mutually variable.

Figure 2A:
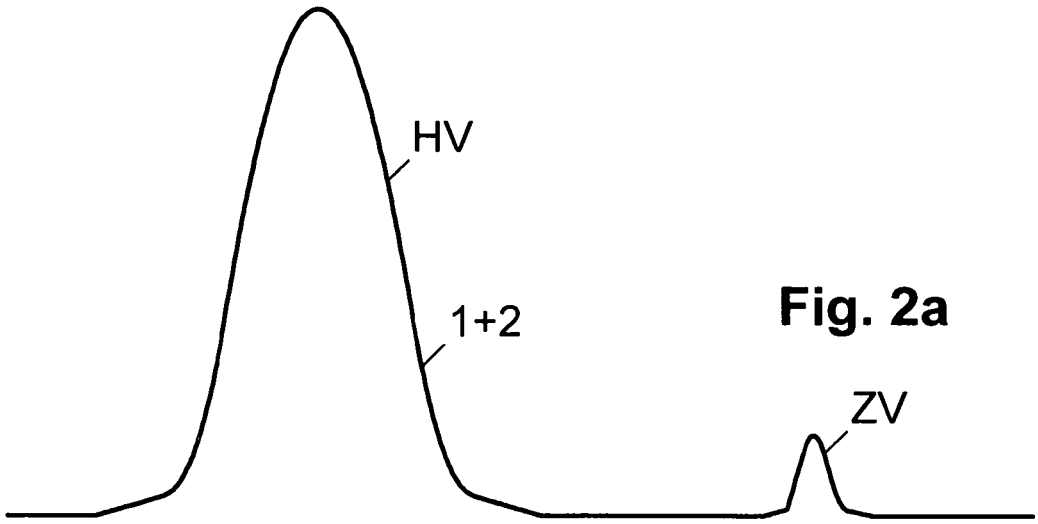
Figure 2B:
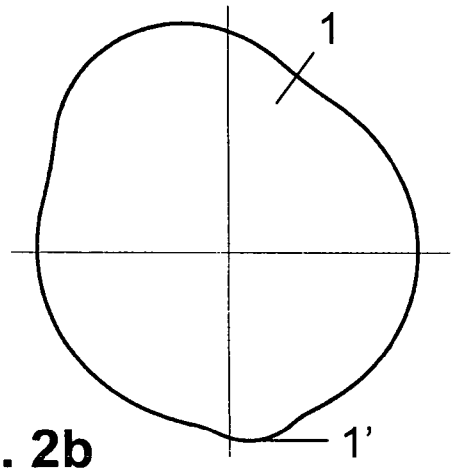
Figure 2C:
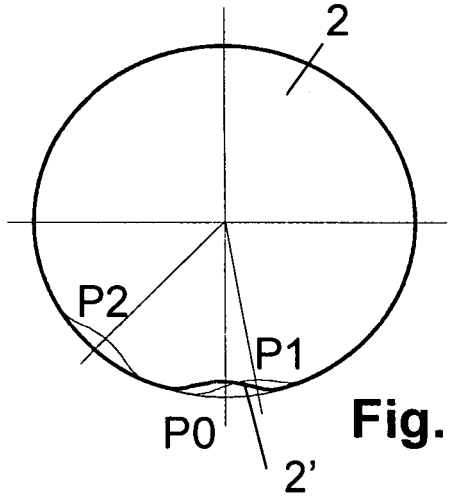
Figure 2D:
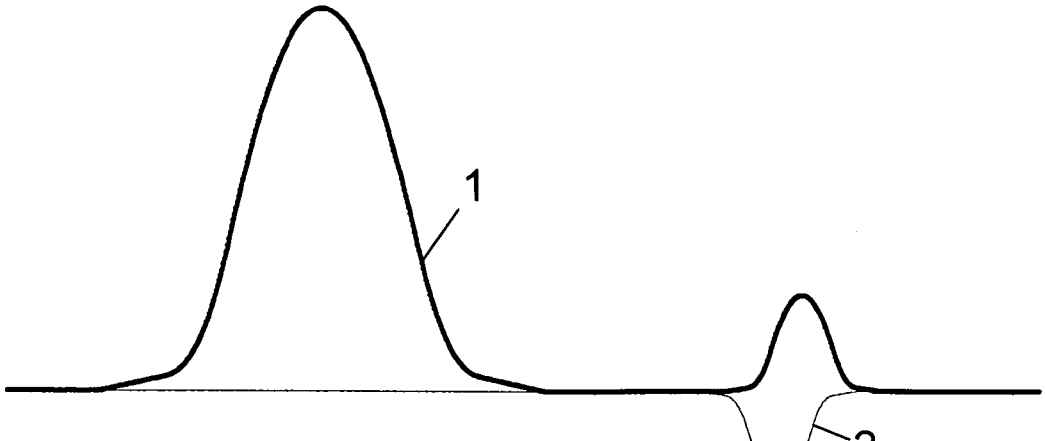
Figure 3A:
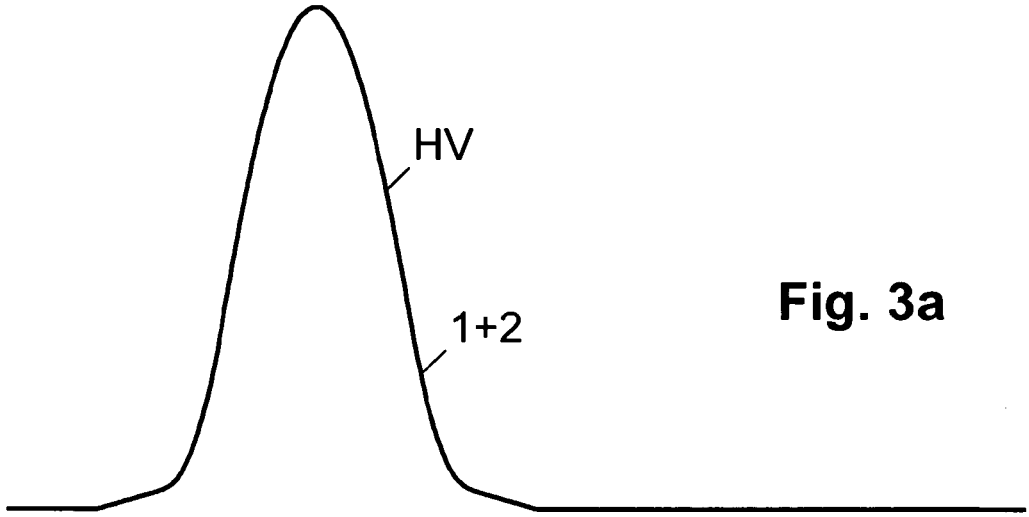
Figure 3B:
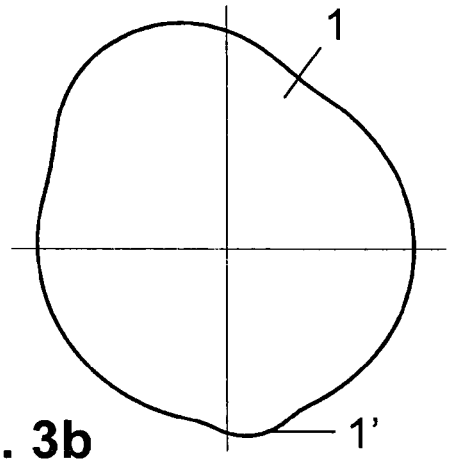
Figure 3C:
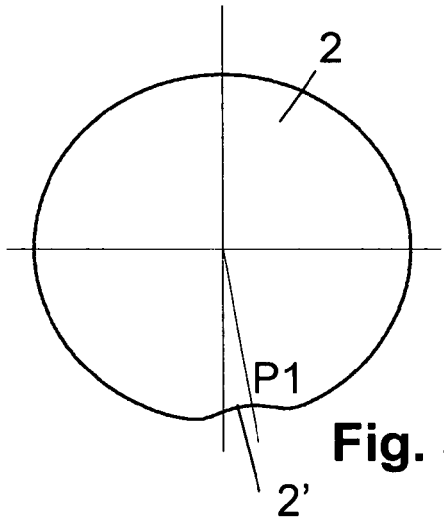
Figure 3D:
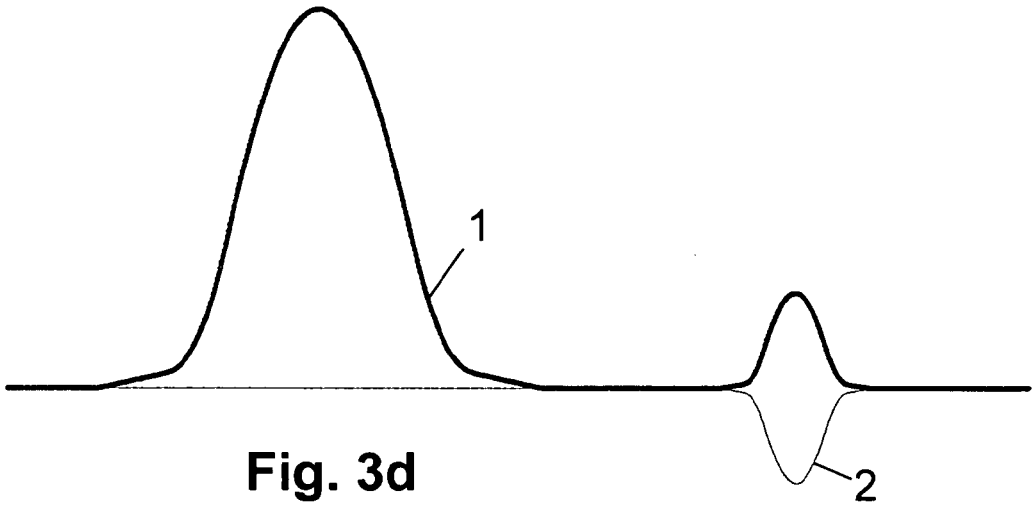
Figure 4A:
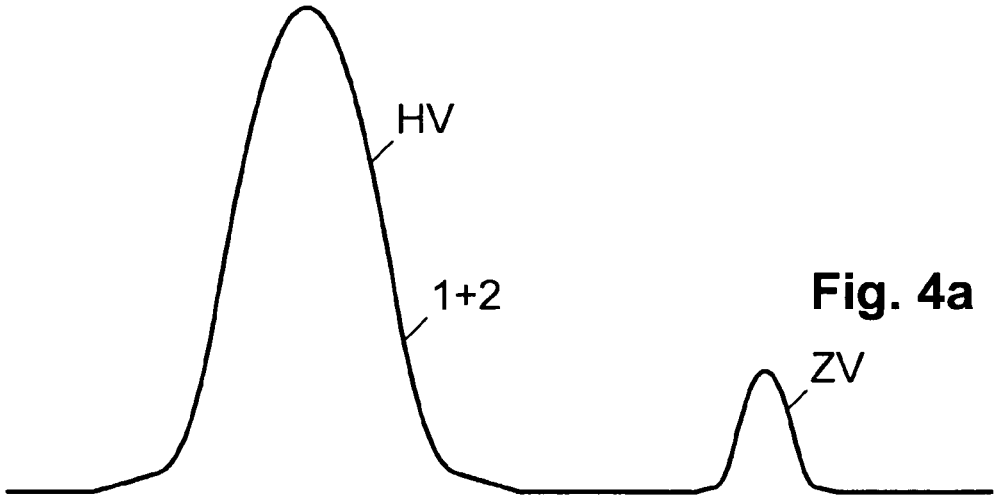
Figure 4B:
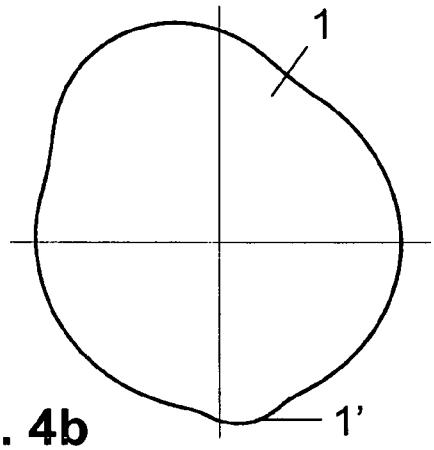
Figure 4C:
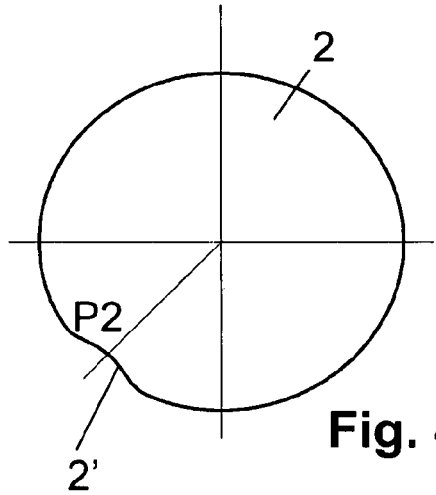
Figure 4D:
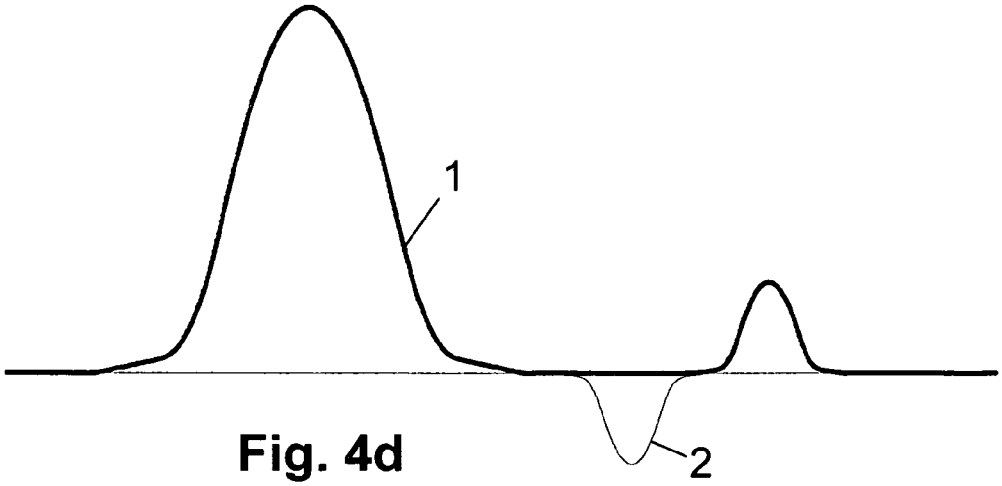

The valve movements achievable with the forms of the cam profiles 1 and 2 illustrated in FIGS. 2*b* and 2*c* are explained on the basis of the diagrams in FIGS. 2*a* through 4*a*.

FIGS. 2*b* and 2*c* show the two synchronously rotating cab profiles 1 and 2 in cross section.

These two cam profiles 1, 2 each have a basic shape for generating a valve-lifting movement according to a main valve displacement curve and a superimposed form for generating an additional lifting movement according to an additional valve displacement curve. These additional forms in the cam profiles 1 and 2 are entered with 1' in the first cam profile 1 in FIG. 2*b* and with 2' in the second cam profile 2 in FIG. 2*c*. These two cam displacements 1', 2' are designed for a mutual superpositioning with a resulting action upon the lift-actuating element 4 according to FIG. 1, for example. The profile curves of the cam profiles 1 and 2 are shown jointly for a revolution of the cam profile in FIG. 2*d* and are labeled accordingly as 1 and 2 in a phase relation $P_0$ of the cam profiles according to the diagram in FIG. 2*c*.

Superimposing these two cam profile curves generates a valve displacement curve on the valve to be operated with respect to a full revolution of the cam profiles 1, 2, this valve displacement curve being composed of a main valve displacement curve HV and an additional valve displacement curve ZV.

FIG. 2*c* shows two other phase relations P1 and P2 of the cam profile 2 such as those needed for FIGS. 3 and 4.

FIGS. 3 and 4 each show a phase shift between the two cam profiles 1 and 2 through exclusively a revolution of the second cam profile 2 in comparison with the first cam profile 1, namely by the phase angle P1 in FIG. 3 and the phase angle P2 in FIG. 4 resulting in different additional valve displacement curves ZV corresponding to the diagrams in FIGS. 3 and 4. The phase adjustment between the two cam profiles 1 and 2 is shown here only as an example illustrated by the revolution of the second cam profile 2 with respect to the first cam profile 1 and may of course also be implemented by rotation of the first cam profile 1 with respect to the second cam profile 2 or by rotation of the two cam profiles in the same direction or in opposite directions by the same or different angles of adjustment. Any additional adjustment possibility not mentioned here should be applicable for an inventive control unit.

With the cam profile shapes according to FIGS. 2 through 4, the main valve displacement is generated by (in this example) the cam lift of the first cam profile 1 and the maximum lift range of the cam profile 2. The main valve displacement does not depend on the phase relation of the second cam profile 2 with respect to the first cam profile 1. In a phase relation of the two cam profiles 1, 2 to one another as represented by position P1 of the second cam profile 2 in FIG. 2*c*, which then forms the basis for FIG. 3, the positive displacement 1' of the first cam profile and the negative, inwardly directed recess 2' in the second cam profile 2 are emphasized by superpositioning them, as illustrated in FIG. 3*a*.

For the superpositioning of the cam profiles, yielding the valve displacement curves, it must be pointed out with respect to the drawing that there is no correspondence in scale between the diagrams in parts a through d and the profile curves of cam profiles 1 and 2. This is apparent due to the fact that there is a translational movement between the moving valves and the motion-inducing cam profiles 1, 2 due to force transmission elements situated in between. These diagrams are presented merely to illustrate the basic relationship.

Figure 5A:
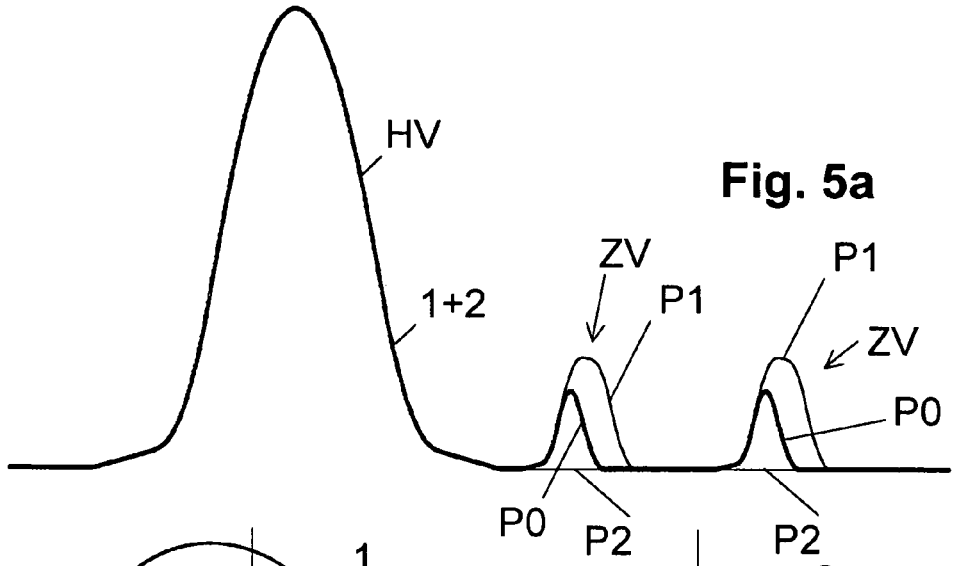
Figure 5B:
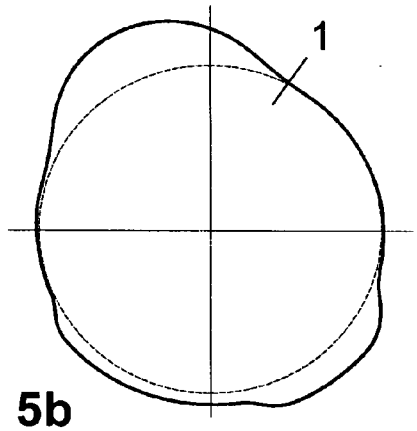
Figure 5C:
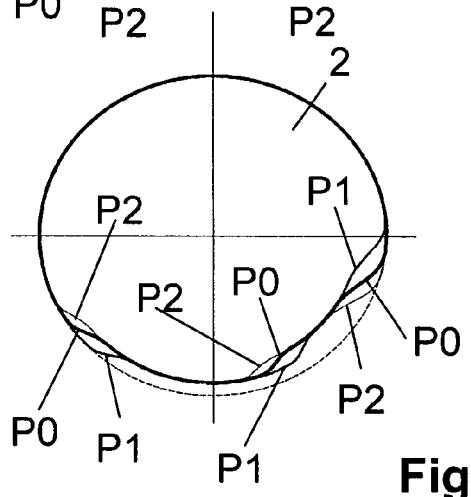
Figure 5D:
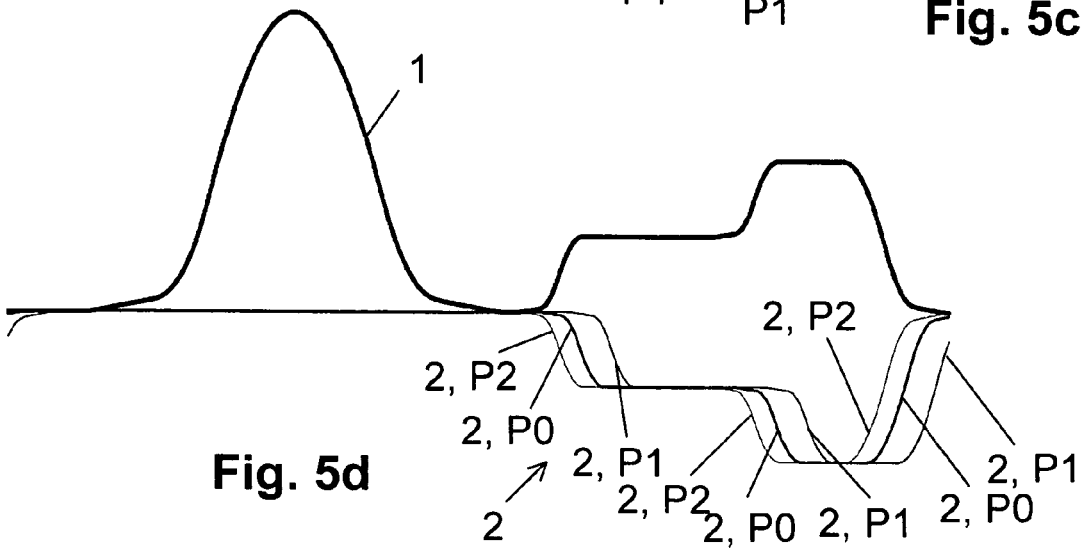

FIG. 5 shows cam profile shapes of the two cam profiles 1, 2, in which the three valve displacement curves illustrated in FIG. 5*a* are obtained by taking into account a total of three different phase angles of the two cam profiles 1, 2 in relation to one another, i.e., a main valve displacement curve HV and two additional valve displacement curves ZV. The profile curves of the cam profiles 1 and 2 in FIG. 5*d* are derived from the corresponding cam profile shapes from FIGS. 5*b* and 5*c*.

Figure 6A:
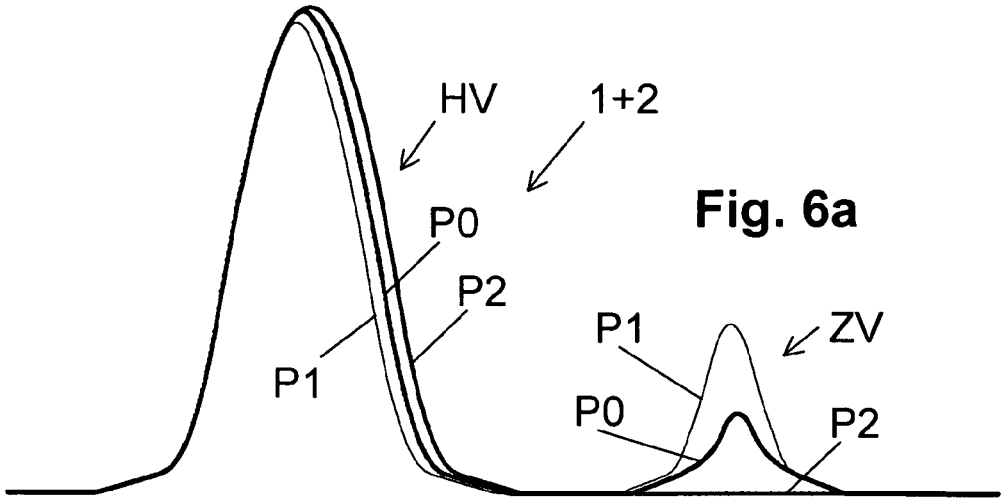
Figure 6B:
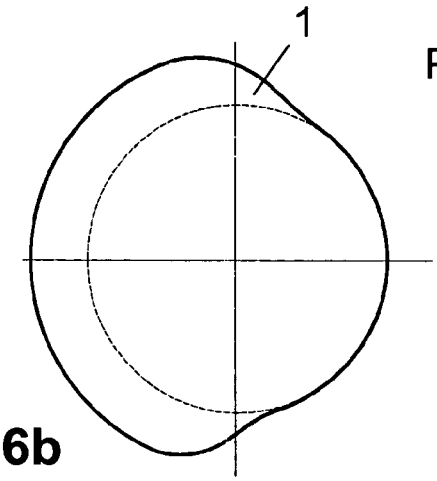
Figure 6C:
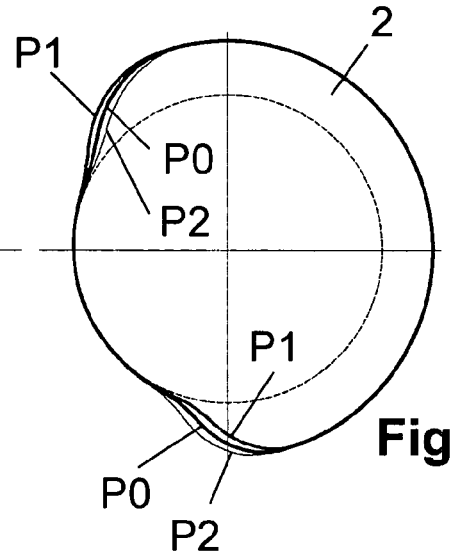
Figure 6D:
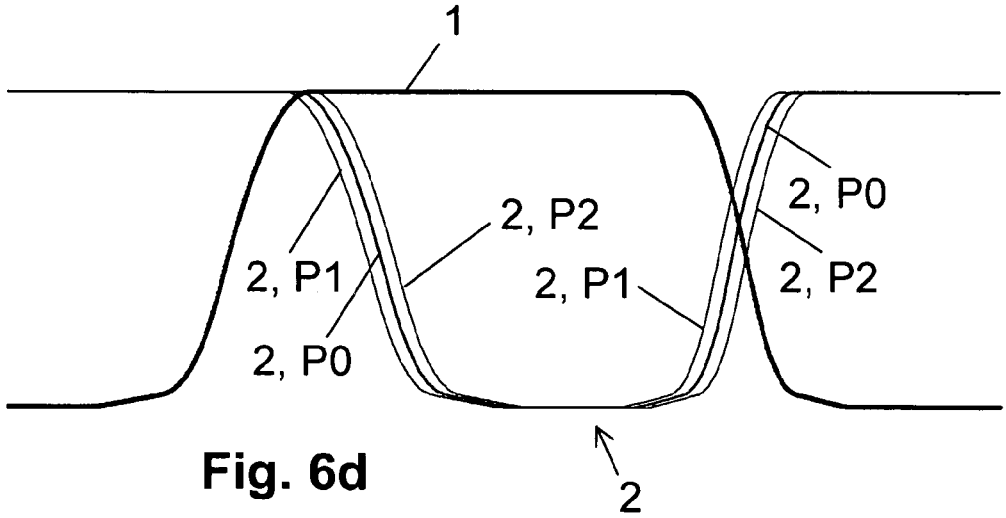
Figure 7A:
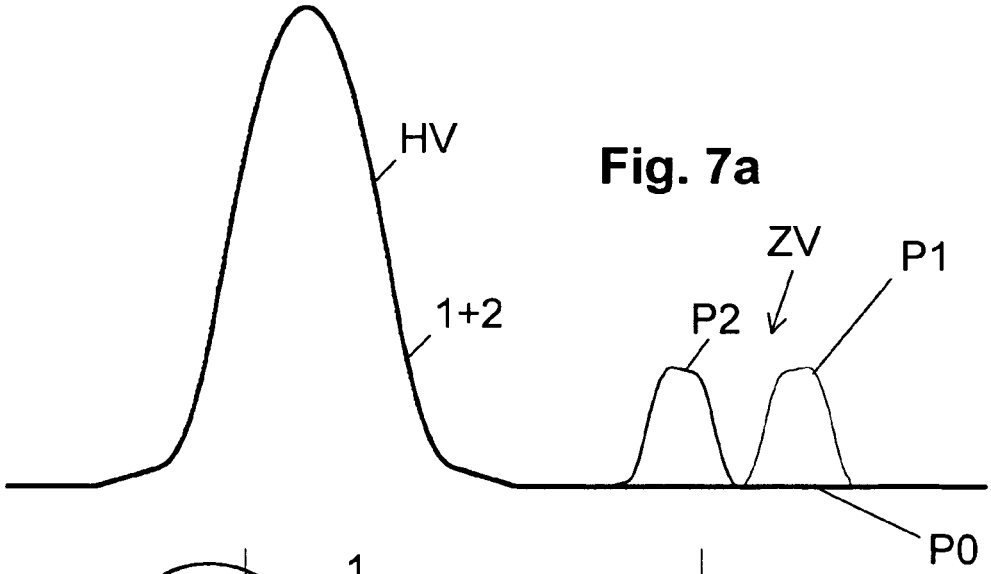
Figure 7B:
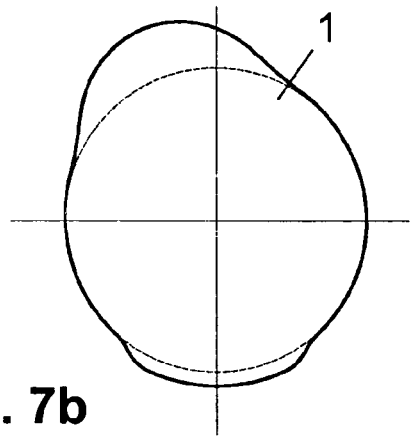
Figure 7C:
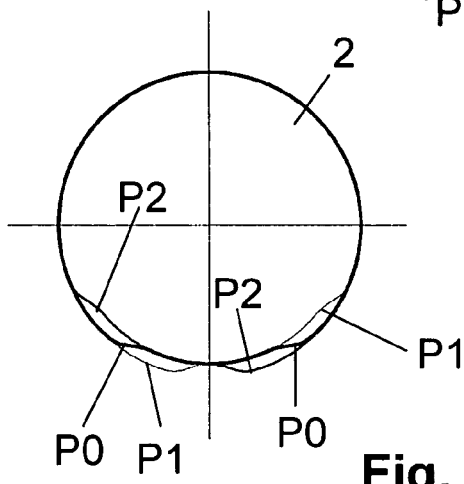
Figure 7D:
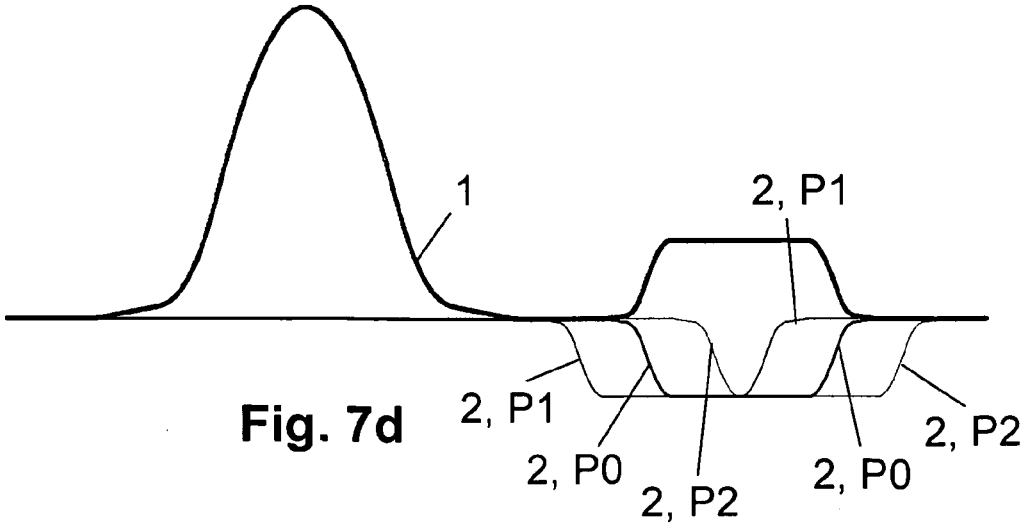
Figure 8A:
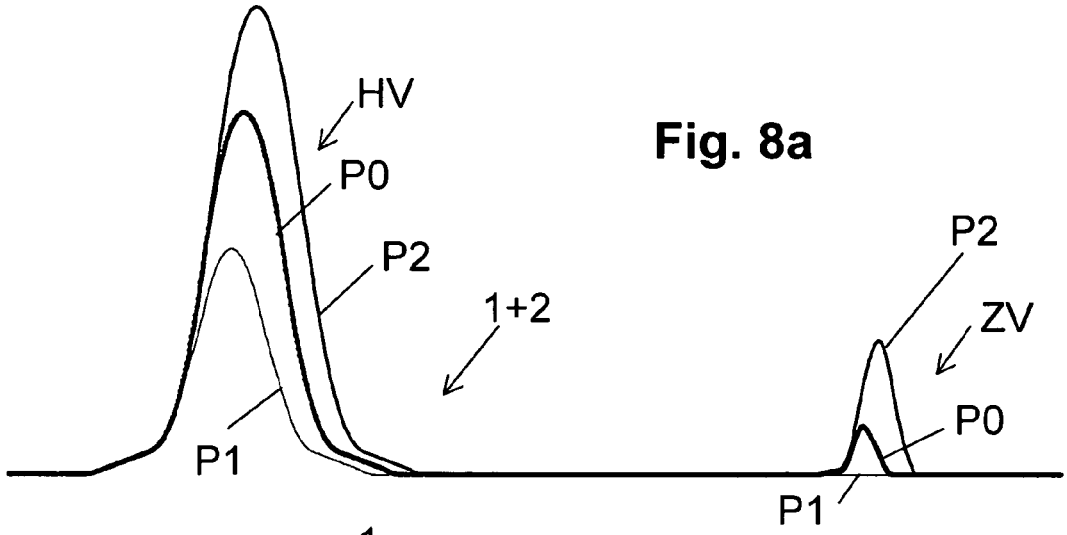
Figure 8B:
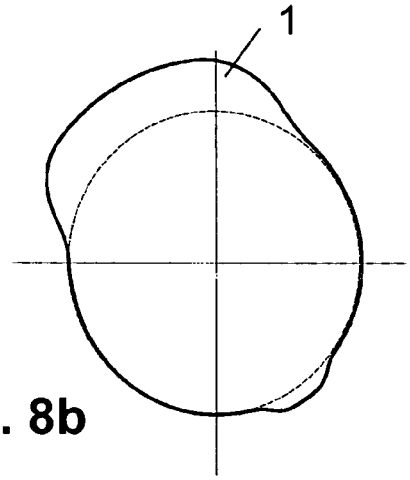
Figure 8C:
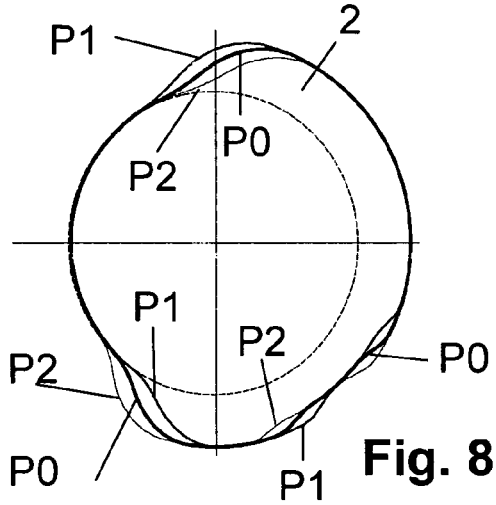
Figure 8D:
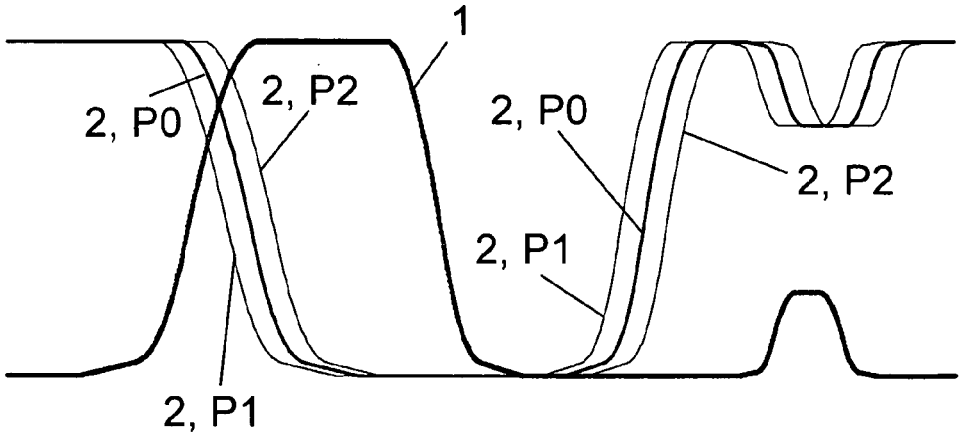

The diagrams in FIGS. 6, 7 and 8 are constructed in the same way as the diagram in FIG. 5 and differ from the diagram in FIG. 5 only in the different shapes of the cam profiles 1, 2 and the resulting different valve displacement curves in FIGS. 6*a*, 7*a* and 8*a*.

In comparison with the other valve displacement curves, those shown in FIGS. 6 and 8 have a particular feature with respect to the main valve displacement curve HV, namely that here again, this main valve displacement curve HV is altered by corresponding cam profiles 1, 2 and their phase shift in relation to one another.

With regard to the cam profile shapes in FIG. 6, it should be pointed out that the main valve displacement curve here is generated by the increasing cam lift of the first cam profile and the decreasing cam lift of the second cam profile 2. The additional valve displacement here is generated by the decreasing cam lift of the first cam profile 1 and the increasing cam lift of the second cam profile 2. When there is a change in phase relation between the first and second cam profiles 1, 2, the main valve displacement changes together with the respective additional valve displacement in relation to the respective phase shift.

In all embodiments according to the present invention, the method of generating the valve displacement curves by the two cam profiles 1, 2 as described with respect to the examples according to FIGS. 6 and 8 is especially advantageous. This means that to generate the main valve displacement curve, essentially the increasing and decreasing cam profile areas of the two cam profiles 1 and 2 may be used an in particular should be used.

All the features depicted in the description and characterized in the following claims may be essential to the invention either individually or in any desired form.

The invention claimed is:

1. A control unit for operating at least one valve, in particular a gas exchange valve (6) of an internal combustion engine in which the valve lifting movement of the at least one valve (6) is variable by superimposing at least two synchronously rotating cam profiles which act on a lift operating element (4), namely generating a first cam profile (1) and a second cam profile (2), and being variable by phase shift between these two cam profiles (1, 2), both cam profiles (1, 2) have specially shaped areas which, when superimposed, generate at least one additional valve displacement (additional valve displacement curve ZV) are complementary to one of the two cam profiles (1, 2) over a full revolution of each of these cam profiles (1, 2), whereby at least this at least one additional valve displacement curve (ZV) is variable in shape and assignment to the main valve displacement curve (HV) by phase shift between the two cam profiles (1, 2).

2. The control unit according to claim 1, having a plurality of additional valve displacement curves (ZV), wherein the additional valve displacement curves (ZV) are variable in their assignment to one another by phase shift.

3. The control unit according to claim 1, wherein the main valve displacement curve (HV) is also variable simultaneously with the additional valve displacement curve (ZV).

4. The control unit according to claim 1, wherein the main valve displacement curve (HV) is variable in opposition to the additional valve displacement curve (ZV), i.e., when there is a reduction in the main valve displacement there is an increase in the additional valve displacement and vice versa.

5. The control unit according to claim 1, wherein the additional valve displacement curve (ZV) can be varied while the main valve displacement curve (HV) remains unchanged.

6. The control unit according to claim 1, wherein the additional valve displacement can be varied down to a zero displacement.

7. The control unit according to claim 1, wherein the additional valve displacement can be varied to a minimal displacement which does not yield an effective valve opening cross section that is for gas flow.

8. The control unit according to claim 1, wherein the additional valve displacement can be varied by phase displacement between the two cam profiles (1, 2) down to a minimal lift or a zero lift and it recurs with a further phase shift in an altered phase relation (FIG. 7).

9. The control unit according to claim 1, wherein this unit is used at the intake and/or exhaust ends for internal exhaust recycling during engine operation.

10. The control unit according to claim 1, wherein this unit is used at the exhaust end for decompression (engine braking operation) during operation of the engine.

11. The control unit according to claim 1, wherein this unit is used for internal charging at the exhaust end during engine operation.

12. The control unit according to claim 1, wherein this unit is used at the exhaust end and/or at the intake end to implement a new combustion method during engine operation.

13. The control unit according to claim 1, wherein multiple additional valve displacement curves (ZV) can be generated as a function of the phase shift between the two cam profiles (1, 2) and can be varied in the same direction or in different directions.

14. The control unit according to claim 1, wherein by means of this control unit, it is possible to switch between engine operation, engine operation with internal exhaust gas recycling and engine braking operation.

* * * * *